US005427317A

United States Patent [19]

Hüttlin

[11] Patent Number: 5,427,317

[45] Date of Patent: Jun. 27, 1995

[54] SLOTTED NOZZLE FOR DISPENSING LIQUIDS

[76] Inventor: Herbert Hüttlin, Daimlerstrasse 7, Steinen, Germany, 79585

[21] Appl. No.: 122,441

[22] PCT Filed: Mar. 27, 1992

[86] PCT No.: PCT/EP92/00682

§ 371 Date: Sep. 24, 1993

§ 102(e) Date: Sep. 24, 1993

[87] PCT Pub. No.: WO92/17280

PCT Pub. Date: Oct. 15, 1992

[30] Foreign Application Priority Data

Mar. 27, 1991 [DE] Germany ..... 41 10 127.8

[51] Int. Cl.[6] ..... B05B 7/08; B05B 7/10; B05B 1/04

[52] U.S. Cl. ..... 239/422; 239/424; 239/452; 239/597

[58] Field of Search ..... 239/8, 422–424, 239/428, 433, 451, 452, 455, 543, 549, 592, 597; 266/113, 259

[56] References Cited

U.S. PATENT DOCUMENTS

| | | | |
|---|---|---|---|
| 3,750,955 | 8/1973 | Nakai et al. | 239/597 |
| 5,012,980 | 5/1991 | Viannay et al. | 239/423 |
| 5,118,041 | 6/1992 | Chastang et al. | 239/424 |

FOREIGN PATENT DOCUMENTS

| | | | |
|---|---|---|---|
| 041729 | 12/1981 | European Pat. Off. . | |
| 241981 | 5/1910 | Germany . | |
| 3443263 | 6/1986 | Germany | 239/597 |
| 3806537 | 9/1989 | Germany . | |

*Primary Examiner*—Karen B. Merritt
*Attorney, Agent, or Firm*—Brumbaugh, Graves, Donohue & Raymond

[57] ABSTRACT

An outlet slot (A) for generating a spray curtain (C) is defined by mutually abutting outlet faces of two outer nozzle elements (30) and one central nozzle element (31), all being connected to a support body (10) and separable from each other. At least the two outlet faces (32) of the central nozzle element (31) have a profiled structure roughened, for instance, by sandblasting and to permit discharge of the liquid. Two nozzle slats (40) are connected to the support body (10) and the two nozzle elements (30) are arranged between them. Together with one nozzle slat (40) each the two nozzle elements (30) define a gas outlet slot (D) which likewise extends along the spray curtain (C) to be formed.

8 Claims, 6 Drawing Sheets

SLOTTED NOZZLE FOR DISPENSING LIQUIDS

The invention relates to a slotted nozzle for dispensing liquids, comprising

- a support body which includes at least one supply duct for liquids, and
- nozzle elements connected to the support body and separable from each other and letting liquid exit between them,
- at least one of the nozzle elements, together with a nozzle slat, defining a gas outlet slot which is connected to a pressurized gas supply duct likewise formed in the support body.

A slotted nozzle of this kind serving as a linear spray device to cool sheet metal leaving a hot rolling mill, for instance, is known from document WO 89 10 203 A. With this known slotted nozzle the nozzle bodies are spaced from one another so that they present an open outlet gap.

Document DE 24 19 81 A likewise discloses a linear spray device. This device comprises a hollow body which is disposed inside a housing and around which compressed air flows while the hollow body itself is fed with liquid, e.g. paint. Compressed air and liquid pass through a perforated plate before they issue together from a multi-jet nozzle. The latter is embodied by a middle plate abutted at either side by a plate provided with passages. A liquid outlet is not provided between the outlet faces formed by the plates since the liquid introduced into the device is intended to be atomized before reaching the perforated plate. The mixture of substances issuing between the plates consequently is not a liquid but a mist. Neither of the two plates which might be referred to as nozzle elements defines a gas outlet slot together with a nozzle slat. Therefore, a possibility for (renewed) vaporization of condensed liquid does not exist.

Another slotted nozzle is known from document EP 0 041 729 A, one of its nozzle elements is a stiff plate which is screw connected to the support body, likewise embodied by a plate, and covers a groove formed in the support body and serving as supply duct. The second nozzle element is formed by a flexible slat which is clamped in another groove in the supply body and formed in the area in which it abuts against the stiff nozzle element with a plurality of grooves cut out and lands left in between.

The lands preferably are much narrower than the grooves and their cross section in longitudinal direction of the support body is longer than transversely thereof. The conditions of flow out of the nozzle are to be influenced in response to the properties of the medium to be discharged from the slotted nozzle by different dimensioning of the lands and grooves. The lands and grooves may be disposed transversely or obliquely with respect to the longitudinal direction of the slotted nozzle and may terminate before the actual nozzle outlet cross section so that the partial flows of the issuing medium which were separated by the lands can combine to form a uniform film downstream of the lands. In this manner it is intended to obtain a continuous veil of gas or liquid. Yet experience has shown that this is achieved only with liquids having low surface tension so that the partial streams flowing through the individual grooves have a strong tendency to unite once they left the lands.

It is the object of the invention to improve a slotted nozzle for dispensing liquids such that it will be useful for producing a uniform spray curtain made up of a liquid and a gas.

Starting from a slotted nozzle of the kind defined initially, this object is met, according to the invention, in that the nozzle elements have abutting outlet faces and the outlet face of at least one of the nozzle elements is roughened so s to have a depth of roughness of from 0.015 to 0.250 mm., whereby the exit of liquid is made possible between the abutting outlet faces.

The roughened outlet face can be combined with a totally smooth outlet face. This pairing of rough and smooth outlet faces and a gas outlet slot is especially well suited for dispersing homogeneous solutions.

The nozzle elements preferably are held in mutual abutment by elastic bias. That makes it possible to clean the outlet slot from time to time with a liquid which is pressed through at higher pressure, urging the nozzle elements apart. The bias can be generated, for example, by means of elastic guide plates connecting one each of the nozzle elements to the support body.

The support body may be divided into two support body halves each carrying one nozzle element in order to facilitate also the cleaning of the support body itself.

It is convenient to have two nozzle slats connected to the support body and the nozzle elements disposed between them.

It is likewise advantageous to have at least one nozzle slat connected to the support body by an elastic guide plate. Such a guide plate can start to vibrate in response to the pressure of the gas which flows along it, and thereby the spacing between the associated nozzle slat and the adjacent nozzle element will vary periodically, producing a pulsating flow of gas which is desirable in certain cases.

An especially advantageous further development of the invention resides in the fact that a lamella-like third nozzle element is arranged between two smooth nozzle elements. This third nozzle element has roughened outlet faces at both sides facing a smooth nozzle element each. Such a lamella-like nozzle element can be produced at low cost and is readily exchangeable.

The lamella-like third nozzle element conveniently is clamped between two halves of the support body and divides the supply duct for liquids into two halves. This provides an opportunity to feed the two halves of the supply duct with different liquids, such as two components which interreact chemically and therefore should not get together until they have left the slotted nozzle. The components leave the slotted nozzle according to the invention separately at one side each of the lamella-like nozzle element and then mix as a mist which will deposit, for instance, on a surface to be coated. In this manner e.g. coatings of dual-component varnishes, adhesives or the like can be produced at low labor cost.

The roughening of one or more outlet faces preferably is accomplished by known methods of non-cutting shaping, such as electric discharge machining. However, procedures which subject the surface to be roughened to small particle shots, such as blasting with sand grains have proved to be especially well suited.

Embodiments of the invention will be described in greater detail below. In the drawings.

Figure 1:
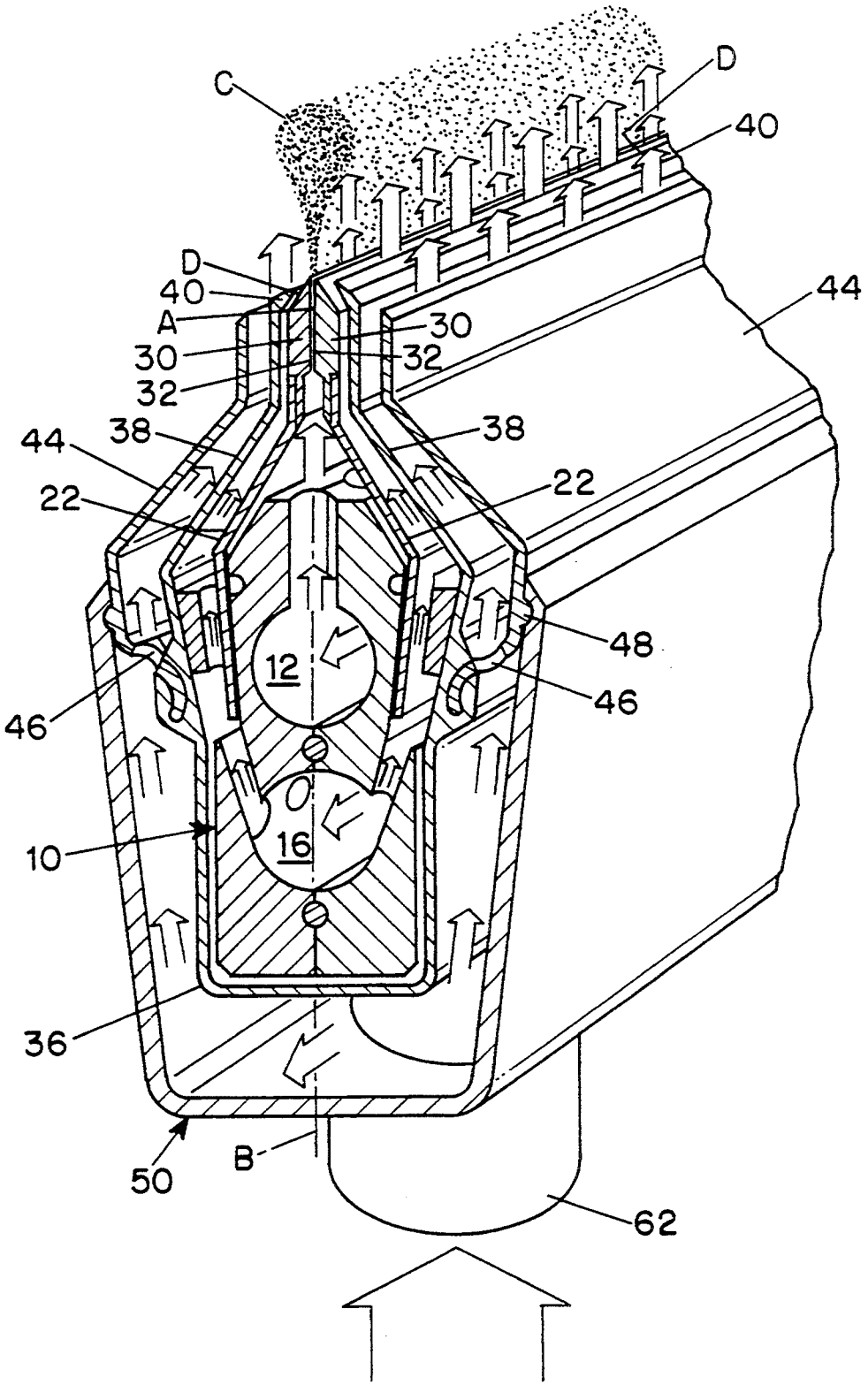
FIG. 1 is an oblique view, partly in cross section, of a first slotted nozzle according to the invention.
Figure 2:
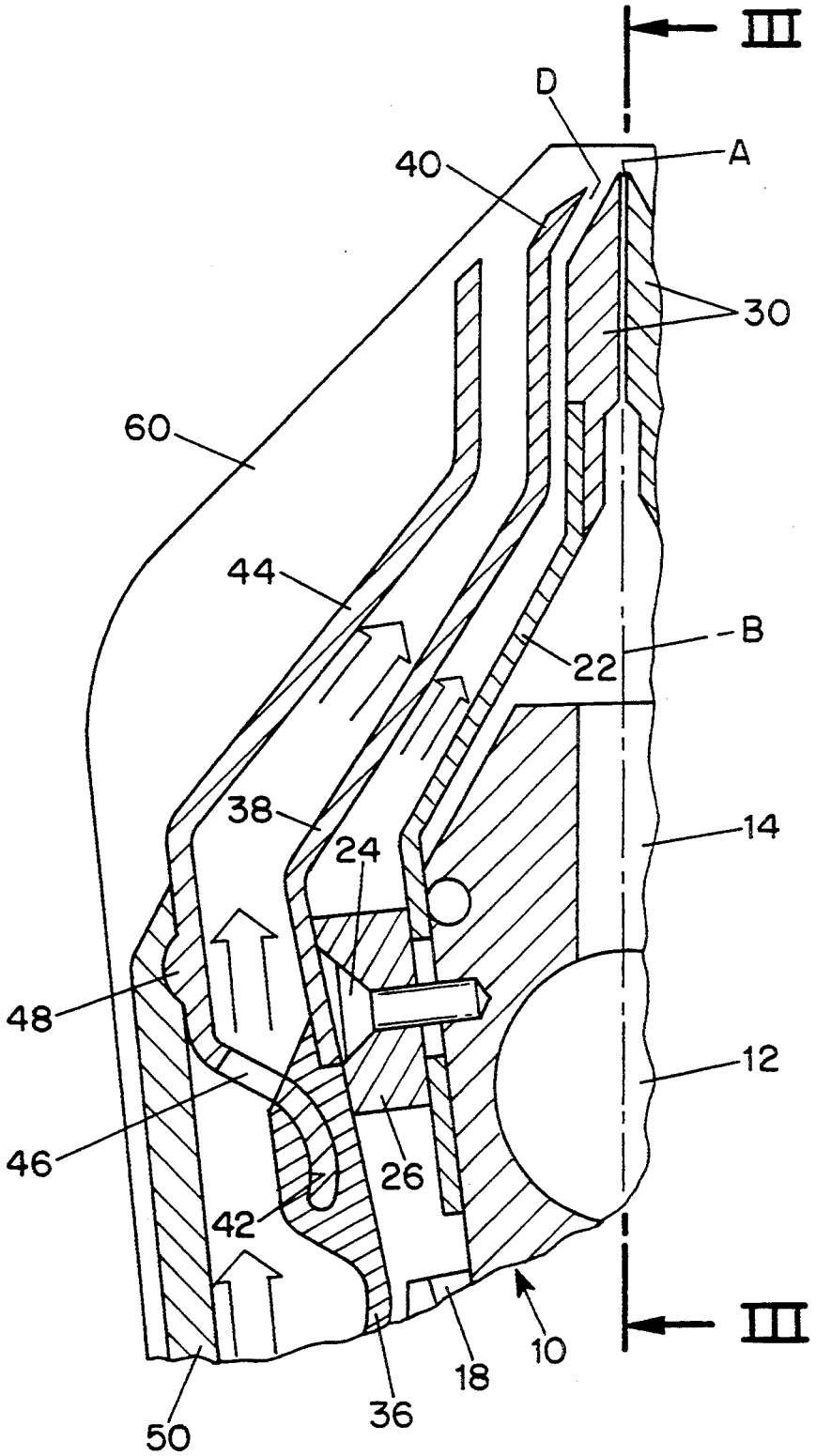
FIG. 2 is an enlarged detail of FIG. 1.

The slotted nozzle shown in FIGS. 1 to 4 is rectlinearly elongated and symmetrical with respect to a plane which is vertical in FIGS. 1 and 2. The slotted nozzle comprises an elongated support body 10 formed with a liquid supply duct 12 from which transverse bores 14 lead upwardly and with a pressurized gas supply duct 16 from which inclined bores 18 lead upwardly. The support body 10 is symmetrical and divided into two like support body halves which are held together by screws 20 and can be separated easily upon loosening of those screws.

An inner guide plate 22 each is fastened to the two halves of the support body 10 by screws 24 and clamping slats 26 so as to be adjustable in height. The clamping slats 26 are formed with grooves 28 so that pressurized gas fed through the supply duct 16 and exiting upwarldy through the inclined bores 18 can flow in upward direction through the clamping slats 26.

At a level above the region at which they are fixed to the support body 10, the two inner guide plates 22 are bent so as to converge in upward direction and they are further bent so their upper marginal zones extend in parallel with each other. A nozzle element 30 which is rectilinearly elongated, as shown, but may also be bent annularly or otherwise, is fastened to the upper marginal zone of each of the inner guide plates 22. The two nozzle elements 30 have vertical outlet faces 32, as seen in FIG. 1, which are facing each other and together define an outlet slot A in the plane of symmetry B of the slotted nozzle for generating a spray curtain C. One of the two outlet faces 32 has a profiled structure obtained by sandblasting. The opposed outlet face 32 is smooth.

Figure 3:
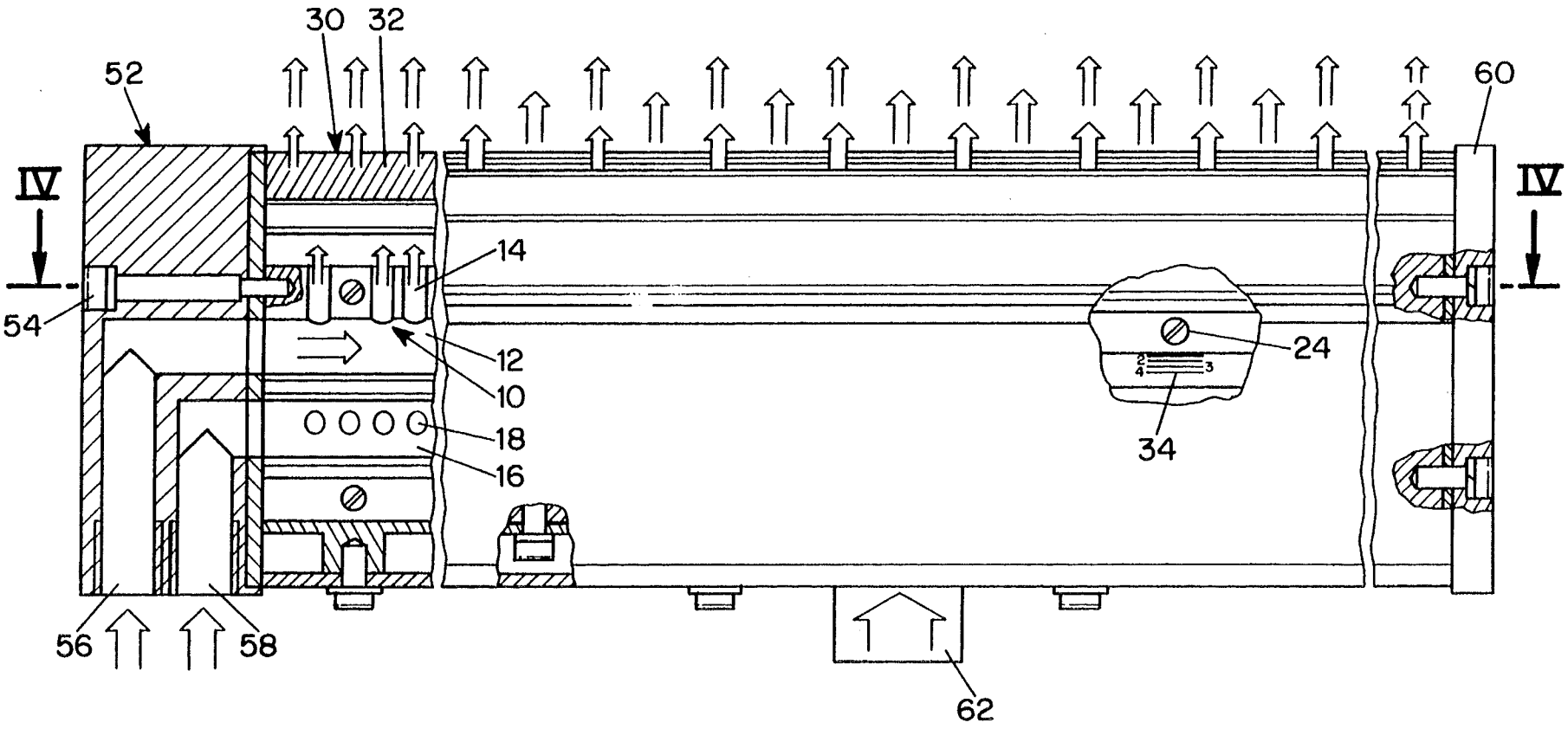
FIG. 3 is a side elevational view of the slotted nozzle, partly drawn as section III—III in FIG. 2.

The two inner guide plates 22 are made of elastic material, preferably stainless steel sheet, and they are shaped and arranged in such manner that, under normal operating conditions, they hold the two outlet faces 32 in mutual abutment at a certain bias. Those surfaces of the support body 10 to which the inner guide plates 22 are attached diverge in upward direction. The bias acting between the outlet faces 32 thus can be strengthened or weakened, as desired, by adjusting the inner guide plates 22 downwardly or upwardly. The adjustment of the guide plates 22 can be read from scales 34 (FIG. 3).

In its lower part, the support body 10 is enclosed by a sheath member 36 which is U-shaped in cross section and made, for instance, of extruded sectional metal or plastics having two thickened upper edge zones. At these edge zones of the sheath member 36 a pair of middle guide plates 38 are fastened so as to prolong the profile of the sheath member 36 in upward direction by being bent in a manner similar to the inner guide plates 22.

The middle guide plates 38 likewise are made of elastic material, preferably stainless steel sheet, and their upper edges form a pair of upwardly converging nozzle slats 40 between which the nozzle elements 32 are disposed. Together with the respective adjacent nozzle memeber 30, each of the two nozzle slats 40 defines a gas outlet slot D whose width is uniform throughout its length. The width of the two gas outlet slots D is the greater the further down the inner guide plates 22 are adjusted, and vice versa. In its two thickened upper edge zones, the sheath member 36 has an outwardly open groove 42 each, the grooves being curved like circular arcs, and a lower edge zone of corresponding curvature formed at an outer guide plate 44 each is inserted therein. The two outer guide plates 44 are bent in a manner corresponding to that of the inner guide plates 22 and the middle guide plates 38 and are formed, adjacent their edges inserted in the arcuate grooves 42, with apertures 46 for upwardly flowing low pressure gas, and directly above those apertures with an outwardly projecting longitudinal bead 48 each.

A U-shaped basin 50 formed with a groove along each of its upper edges, is snapped into engagement with those longitudinal beads 48. The basin 50 may be made of sheet metal bent accordingly or it may be embodied by extruded sectional metal or plastics.

Figure 4:
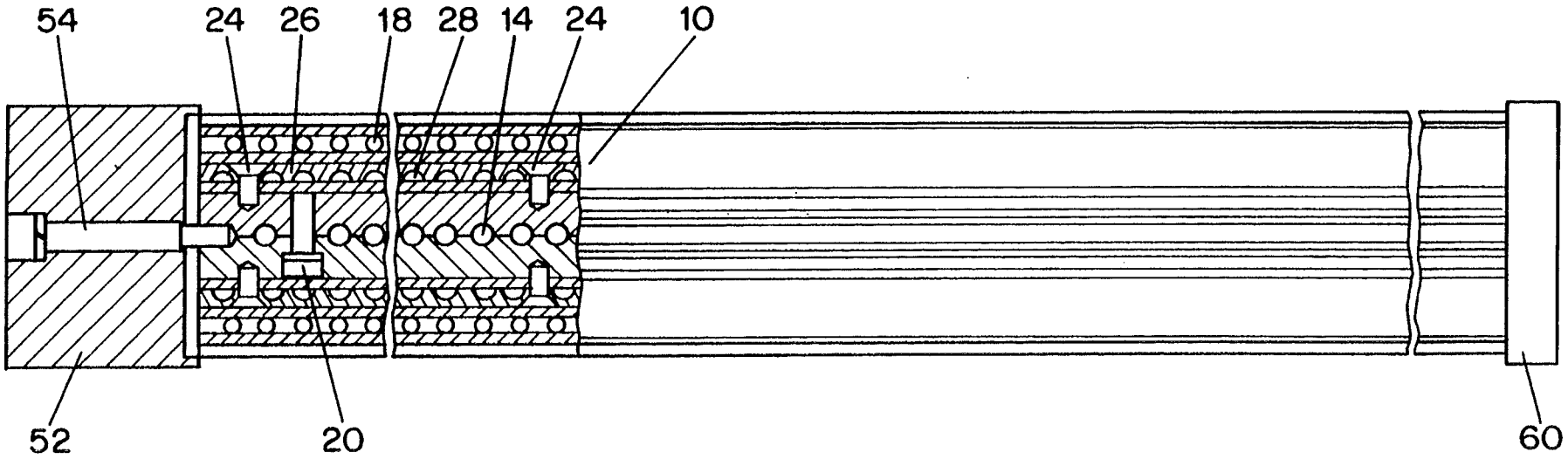
FIG. 4 is a top plan view of the slotted nozzle, partly drawn as section IV—IV in FIG. 3.

The components described above of the slotted nozzle are terminated and held together by a head piece 52 at one end, illustrated at the left in FIGS. 3 and 4. The head piece 52 is fastened to the support body 10 by screw bolts 54 and has a connecting bore 56 which communicates with the supply duct 12 for liquid to be dispersed by spraying as well as a connecting bore 58 for pressurized gas communicating with the supply duct 16, the pressurized gas preferably being fed at a pressure in the order of from 0.5 to 4.0 bars. The other end of the nozzle arrangement is terminated by a simple plate-like end piece 60.

The basin 50 is provided at its bottom with at least one pipe connection 62 for gas which is supplied, when needed, at a low pressure of, for example, less than 0.5 bar. This low pressure gas flows in upward direction between the sheath member 36 and the basin 50 and on through the apertures 46 into the spaces between the middle and outer guide plates to finally form a gas shield outside of the gas outlet slots. If the low pressure gas has a sufficiently high moisture content it may prevent the spray curtain C from being dried prematurely by process air used in a fluidized bed apparatus or the like.

Figure 5:
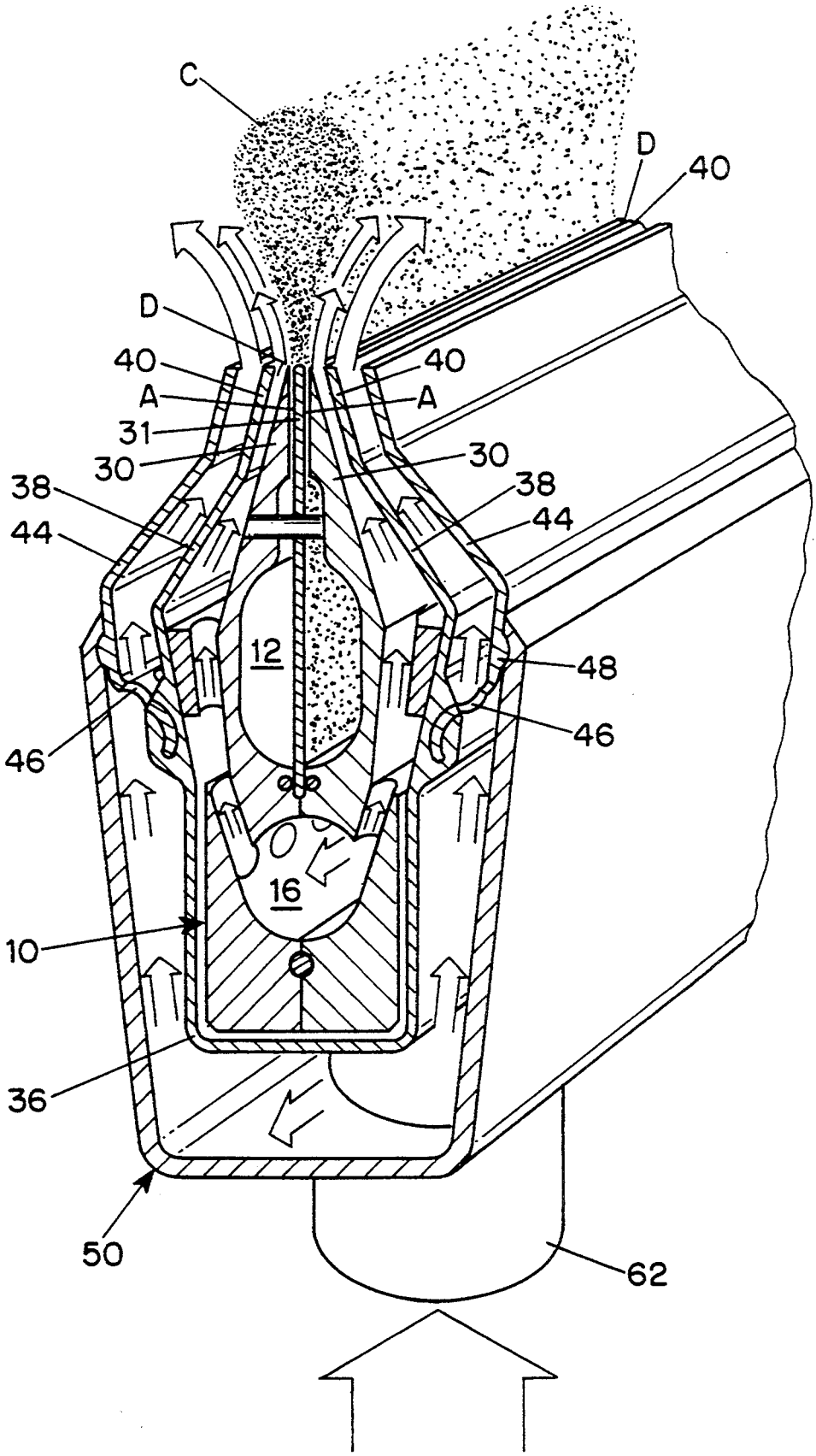
FIG. 5 is an oblique view similar to FIG. 1, showing a second slotted nozzle according to the invention.
Figure 6:
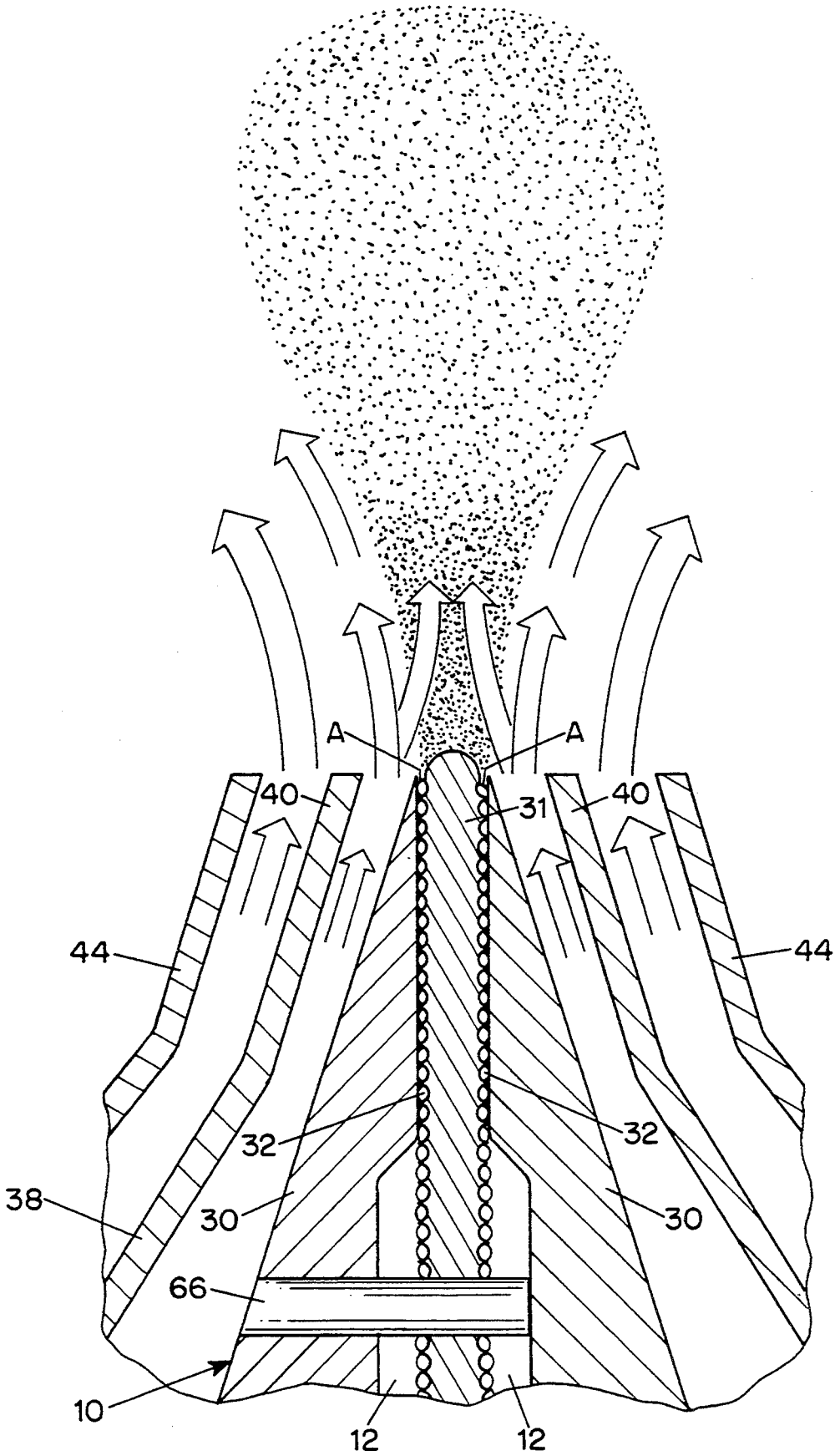
FIG. 6 is an enlarged detail of FIG. 5.

The slotted nozzle according to FIGS. 5 and 6 differs from the one shown in FIGS. 1 to 4 in that a third nozzle element 31 is arranged between the two nozzle elements 30, the third one being embodied by a thin, flat lamella made, for instance, of stainless steel sheet material. At both sides, the third nozzle element 31 has an outlet face 32 roughened by sandblasting. The two nozzle elements 30 each have a smooth, planar outlet face positioned in biased abutment against the adjacent outlet face 32 of the third nozzle element 31.

According to FIGS. 5 and 6, the two nozzle elements 30 each are formed in one piece with one half of the support body 10. The third nozzle element 32 is clamped between the support body halves such that it divides the supply duct 12 for liquids into two like halves. Each of these duct halves can be connected to a liquid source of its own. Two or more pins 66 are secured to one of the support body halves so as to extend at right angles with respect to the plane of symmetry of the slotted nozzle towards the other support body half. The third lamella-like nozzle element 31, provided with appropriate holes, is plugged on these pins 66 which thus hold it firmly against displacement and yet permit ready exchange of the third nozzle element.

What is claimed is:

1. A slotted nozzle for dispensing liquids, comprising a support body (10) which includes at least one supply duct (12) for liquids, and nozzle elements (30, 31) connected to the support body (10) and separable from each other and letting liquid exit between them, at least one of the nozzle elements (30) together with at least one nozzle slat (40) defining a gas outlet slot (D) which is connected to a pressurized gas supply duct (16) likewise formed in the support body (10), characterized in that the nozzle elements (30, 31) are held in mutual abutment by elastic bias and have abutting outlet faces (32), and the outlet face (32) of at least one of the nozzle elements (30, 31) is roughened so as to have a depth of roughness of from 0.015 to 0.250 mm., whereby the exit of liquid is made possible between the abutting outlet faces (32).

2. The slotted nozzle as claimed in claim 1, characterized in that the nozzle elements (30, 31) each are connected to the support body (10) by an elastic guide plate (22).

3. The slotted nozzle as claimed in claim 1 or claim 2, characterized in that the support body (10) is divided into two support body halves which each carry a nozzle element (30).

4. The slotted nozzle as claimed in claim 1, characterized in that two nozzle slats (40) are connected to the support body (10) and the nozzle elements (30) are disposed between them.

5. The slotted nozzle as claimed in claim 1, characterized in that at least one nozzle slat (40) is connected to the support body (10) by an elastic guide plate (38).

6. The slotted nozzle as claimed in claim 1, characterized in that a lamella-like third nozzle element (31) is arranged between two smooth nozzle elements (30), the third nozzle element having a roughened outlet face (32) at both sides which each are facing a smooth nozzle element (30).

7. The slotted nozzle as claimed in claim 1, characterized in that the third nozzle element (31) is clamped between two halves of the support body (10) and divides the at least one supply duct (12) for liquids into two halves.

8. The slotted nozzle as claimed in claim 1, characterized in that at least one of the nozzle elements (30, 31) has an outlet face (32) that has been treated by sand blasting.

* * * * *

UNITED STATES PATENT AND TRADEMARK OFFICE

CERTIFICATE OF CORRECTION

PATENT NO. : 5,427,317

DATED : June 27, 1995

INVENTOR(S) : Herbert Hüttlin

It is certified that error appears in the above-indentified patent and that said Letters Patent is hereby corrected as shown below:

Title Page:
Item [86], "PCT/EP92/00682" should read

-- PCT/EP92/00683 --;

Column 6, line 16, "claim 1" should read -- claim 6 --.

Signed and Sealed this

Fourteenth Day of November, 1995

Bruce Lehman

*Attest:*

BRUCE LEHMAN

*Attesting Officer*

*Commissioner of Patents and Trademarks*